US011294306B2

(12) United States Patent
Nemoto et al.

(10) Patent No.: US 11,294,306 B2
(45) Date of Patent: Apr. 5, 2022

(54) RECORDING MEDIUM AND RECORDING DEVICE

(71) Applicant: Toshiba Infrastructure Systems & Solutions Corporation, Kawasaki (JP)

(72) Inventors: Nobuki Nemoto, Kanagawa (JP); Sumio Ogawa, Aichi (JP); Yasuo Fujimori, Aichi (JP); Yuuji Yoshida, Aichi (JP)

(73) Assignee: Toshiba Infrastructure Systems & Solutions Corporation, Kanagawa (JP)

( * ) Notice: Subject to any disclaimer, the term of this patent is extended or adjusted under 35 U.S.C. 154(b) by 22 days.

(21) Appl. No.: 16/597,529

(22) Filed: Oct. 9, 2019

(65) Prior Publication Data

US 2020/0117122 A1 Apr. 16, 2020

(30) Foreign Application Priority Data

Oct. 10, 2018 (JP) ..... JP2018-192030

(51) Int. Cl.

| | |
|---|---|
| ***G03G 15/20*** | (2006.01) |
| ***G03G 15/01*** | (2006.01) |
| ***G03G 5/12*** | (2006.01) |

(52) U.S. Cl.

CPC ..... *G03G 15/2007* (2013.01); *G03G 5/12* (2013.01); *G03G 15/0121* (2013.01)

(58) Field of Classification Search

CPC ..... B41M 5/46

See application file for complete search history.

(56) References Cited

U.S. PATENT DOCUMENTS

| | | | |
|---|---|---|---|
| 2005/0181498 | A1 | 8/2005 | Lutz et al. |
| 2006/0030484 | A1 | 2/2006 | Kim et al. |
| 2008/0233404 | A1 | 9/2008 | Wolk et al. |
| 2010/0099556 | A1 | 4/2010 | Vetterling et al. |

FOREIGN PATENT DOCUMENTS

| | | | |
|---|---|---|---|
| EP | 3141392 | A2 | 3/2017 |
| JP | H01-127376 | A | 5/1989 |
| JP | 3509246 | B2 | 3/2004 |
| JP | 2005-138558 | A | 6/2005 |
| JP | 4411394 | B2 | 11/2009 |
| JP | 2010-522102 | A | 7/2010 |
| JP | 2011-098536 | A | 5/2011 |
| JP | 2017-052261 | A | 3/2017 |
| JP | 2018-160048 | A | 10/2018 |

OTHER PUBLICATIONS

Extended European Search Report dated Mar. 24, 2020 in corresponding European patent application No. EP19202287.9 (9 pages).

*Primary Examiner* — Ian A Rummel
(74) *Attorney, Agent, or Firm* — Baker Botts L.L.P.

(57) ABSTRACT

A recording medium of an embodiment includes a base material; a first color development layer that is located on the base material and absorbs light of a given wavelength to develop color; a second color development layer that is located closer to an incident side of the light than the first color development layer, transmits visible light and the light, and develops a color by heat; and a photothermal conversion layer that is located closer to an incident side of the light than the second color development layer intended to develop a color, transmits the visible light, and absorbs the light to photo-thermally convert the light into the heat.

9 Claims, 16 Drawing Sheets

FIG.3

| REFERENCE NUMERAL | FUNCTION | THICKNESS [μm] | THERMAL CONDUCTIVITY RATIO [W/m/K] |
|---|---|---|---|
| 11 | BASE MATERIAL | 100 | 0.01 TO 5.00 |
| 12 | LIGHT-ABSORPTION COLOR DEVELOPMENT LAYER | 1 TO 50 | 0.01 TO 50 |
| 13 | LOW-TEMPERATURE THERMOSENSITIVE COLOR DEVELOPMENT LAYER | 1 TO 10 | 0.1 TO 10 |
| 14 | INTERMEDIATE LAYER | 7 TO 100 | 0.01 TO 50 |
| 15 | INTERMEDIATE-TEMPERATURE THERMOSENSITIVE COLOR DEVELOPMENT LAYER | 1 TO 10 | 0.1 TO 10 |
| 16 | INTERMEDIATE LAYER | 7 TO 100 | 0.01 TO 50 |
| 17 | HIGH-TEMPERATURE THERMOSENSITIVE COLOR DEVELOPMENT LAYER | 1 TO 10 | 0.1 TO 10 |
| 18 | PHOTOTHERMAL CONVERSION LAYER | 0.5 TO 10 | 0.01 TO 50 |
| 19 | PROTECTIVE / FUNCTIONAL LAYER | 0.5 TO 10 | 0.01 TO 1 |

FIG.4

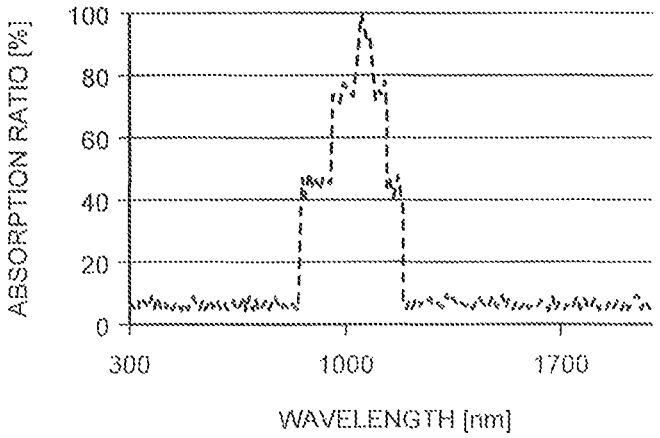

RECORDING MEDIUM AND RECORDING DEVICE

CROSS-REFERENCE TO RELATED APPLICATIONS

This application is based upon and claims the benefit of priority from Japanese Patent Application No. 2018-192030, filed Oct. 10, 2018, the entire contents of which are incorporated herein by reference.

FIELD

Embodiments described herein relate generally to a recording medium and a recording device.

BACKGROUND

Conventionally, there are mainly two laser full-color recording methods, as follows.

A first method is for applying energy with laser to a laminated medium of three primary color development layers having different threshold temperatures for selective color development.

For example, three primary colors are selectively developed by vertically moving the laser focus position with a lens in accordance with an intended layer to develop color.

For another example, a laminated medium of three primary color development layers having different threshold temperatures is applied with heat with laser to develop color having a relatively low threshold temperature, and then dissipate the thermal sensitivity of the color development layer by ultraviolet light so as to cause the color development layer not to develop color when applied with heat. The color development layer that develops color at a second lowest temperature is also subjected to the same process and then the color development layer that develops at a highest temperature, completing full color recording.

A second method employs lasers with three different wavelengths for three primary color layers having absorption characteristics at different wavelengths, to record the colors.

For example, there is a method for full-color recording by causing a multilayer element including at least one layer of a laser-sensitive material to absorb laser light to develop color or decolor.

However, the first method takes a certain time to transfer heat to the low-temperature color development layer, which may elongate total printing time.

The second method uses the three lasers having different wavelengths, which may increase the size and cost of the device.

It is thus preferable to provide a recording medium and a recording device of a simple structure which can record a full-color image quickly with less cost.

BRIEF DESCRIPTION OF THE DRAWINGS

FIG. 3 is an explanatory diagram of the thickness and the thermal conductivity ratio of the recording medium in the first embodiment;

FIG. 4 is an explanatory graph of an example of the light absorption characteristics of a photothermal conversion layer;

DETAILED DESCRIPTION

According to one embodiment, in general, a recording medium includes a base material; a first color development layer that is located on the base material and absorbs light of a given wavelength to develop color; a second color development layer that is located closer to an incident side of the light than the first color development layer, transmits visible light and the light, and develops a color by heat; and a photothermal conversion layer that is located closer to an incident side of the light than the second color development layer intended to develop a color, transmits the visible light, and absorbs the light to photo-thermally convert the light into the heat.

Hereinafter, embodiments and modifications will be described in detail with reference to the accompanying drawings.

First Embodiment

A recording medium of a first embodiment will be described.

Figure 1:
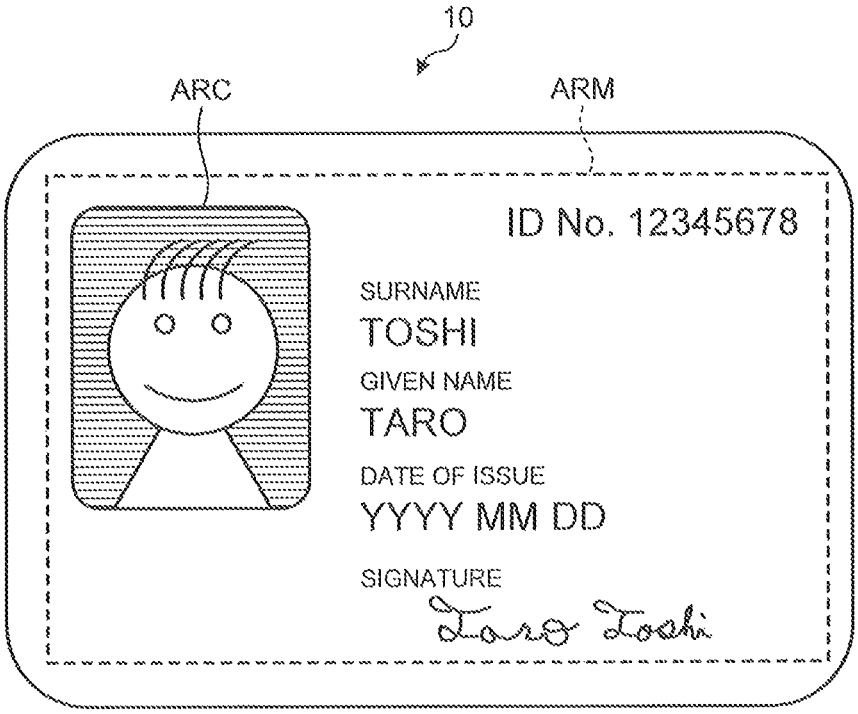
FIG. 1 is an external front view of a recording medium such as an anti-forgery medium on which information is recorded according to the first embodiment.

FIG. 1 is an external front view of a recording medium such as an anti-forgery medium on which information is recorded according to the first embodiment.

A recording medium 10 on which information is recorded mainly includes a full-color image area ARC for recording a full-color image such as an ID photo, and a monochrome image area ARM in contact with the periphery of the full-color image area ARC and on which specific information such ID information, a name, and an issue date is recorded in monochrome.

In FIG. 1, in the recording medium 10, the full-color image area ARC, the monochrome image area ARM, and areas other than these areas exist, but all other areas except the full-color image area ARC may be provided as the monochrome image area ARM.

In FIG. 1, the full-color image area ARC and the monochrome image area ARM are configured to be in contact with each other. However, the full-color image area ARC and the monochrome image area ARM may be arranged separately, or a plurality of either one or both may be arranged.

Figure 2:
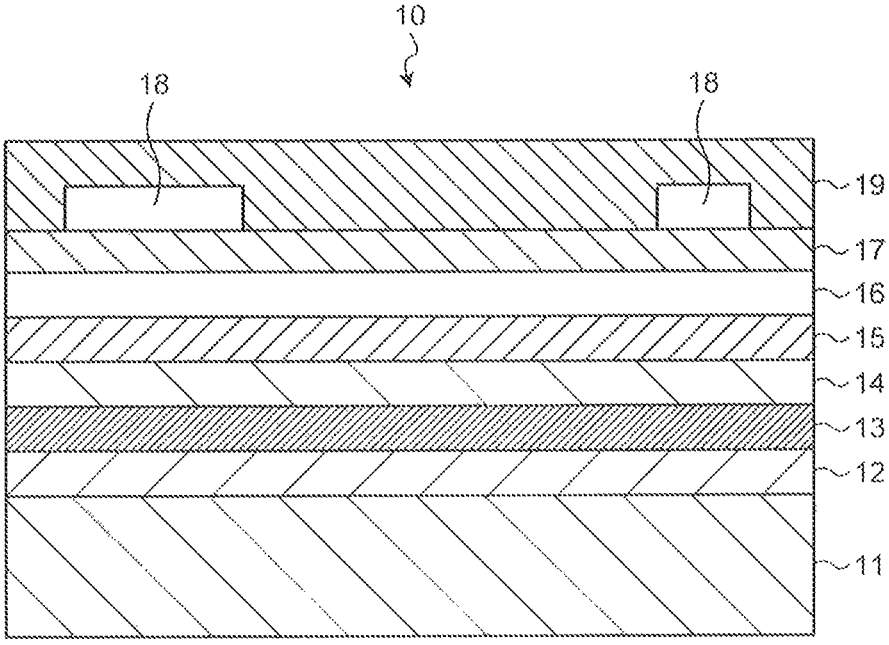
FIG. 2 is a cross-sectional view of a configuration example of the recording medium in the first embodiment.

FIG. 2 is a cross-sectional view of a configuration example of the recording medium of the first embodiment.

FIG. 3 is an explanatory diagram of the thickness and the thermal conductivity ratio of the recording medium of the first embodiment.

As illustrated in FIG. 1, the recording medium 10 includes, on a base material 11, a light-absorption color development layer 12 as a first color development layer, a low-temperature thermosensitive color development layer 13 as a second color development layer, an intermediate layer (binder layer) 14, an intermediate-temperature thermosensitive color development layer 15 as a second color development layer, an intermediate layer 16, a high-temperature thermosensitive color development layer 17 as a second color development layer, photothermal conversion layers 18, and a protective/functional layer 19 in this order.

The low-temperature thermosensitive color development layer 13, the intermediate-temperature thermosensitive color development layer 15, and the high-temperature thermosensitive color development layer 17 each function as a thermosensitive recording layer on which image recording is performed.

Further, the intermediate layer 16 and the intermediate layer 14 each function as a heat insulating layer that adjusts the amount of heat transfer and reduces heat transfer.

In addition, the base material 11 retains the light-absorption color development layer 12, the low-temperature thermosensitive color development layer 13, the intermediate layer 14, the intermediate-temperature thermosensitive color development layer 15, the intermediate layer 16, the high-temperature thermosensitive color development layer 17, the photothermal conversion layers 18, and the protective/functional layer 19.

The thickness of the base material 11 is set to 100 μm, and the thermal conductivity ratio thereof is set to 0.01 to 5.00 W/m/K, for example.

The light-absorption color development layer 12 includes pigment particles, and the pigment particles develop color irreversibly by absorbing and carbonizing laser light for recording.

The thickness of the light-absorption color development layer 12 is set to 1 to 50 μm, and the thermal conductivity ratio thereof is set to 0.01 to 50 W/m/K, for example.

The low-temperature thermosensitive color development layer 13 is a layer containing a temperature indicating material as a thermosensitive material that develops color when its temperature becomes equal to or higher than a third threshold temperature T3.

The thickness of the low-temperature thermosensitive color development layer 13 is set to 1 to 10 μm, and the thermal conductivity ratio thereof is set to 0.1 to 10 W/m/K, for example.

The intermediate layer 14 provides a thermal barrier at the time of color development of the intermediate-temperature thermosensitive color development layer 15 and reduces heat transfer from the intermediate-temperature thermosensitive color development layer 15 side to the low-temperature thermosensitive color development layer 13.

The thickness of the intermediate layer 14 is set to 7 to 100 μm, and the thermal conductivity ratio thereof is set to 0.01 to 50 W/m/K, for example.

The intermediate-temperature thermosensitive color development layer 15 contains a temperature indicating material as a thermosensitive material that develops color when its temperature becomes equal to or higher than a second threshold temperature T2 (>T3).

The thickness of intermediate-temperature thermosensitive color development layer 15 is set to 1 to 10 μm, and the thermal conductivity ratio thereof is set to 0.1 to 10 W/m/K, for example.

The intermediate layer 16 provides a thermal barrier at the time of color development of the high-temperature thermosensitive color development layer 17 and reduces heat transfer from the high-temperature thermosensitive color development layer 17 side to the intermediate-temperature thermosensitive color development layer and the low-temperature thermosensitive color development layer.

The thickness of the intermediate layer 16 is set to 7 to 100 μm, and the thermal conductivity ratio thereof is set to 0.01 to 50 W/m/K, for example.

The high-temperature thermosensitive color development layer 17 contains a temperature indicating material as a thermosensitive material that develops color when its temperature becomes equal to or higher than a first threshold temperature T1 (>T2>T3).

The thickness of the high-temperature thermosensitive color development layer 17 is set to 0.5 to 30 μm, and the thermal conductivity ratio thereof is set to 0.01 to 1 W/m/K, for example.

The photothermal conversion layer 18 absorbs light of a given wavelength (recording laser light) and performs light/heat conversion to generate heat for causing at least one of the high-temperature thermosensitive color development layer 17, the intermediate-temperature thermosensitive color development layer 15, and the low-temperature thermosensitive color development layer 13 to develop color and transfer the heat.

The thickness of the photothermal conversion layer 18 is set to 0.5 to 30 μm, and the thermal conductivity thereof is set to 0.01 to 1 W/m/K, for example.

The protective/functional layer 19 protects the light-absorption color development layer 12, the photothermal conversion layers 18, the intermediate layer 14, the high-temperature thermosensitive color development layer 17, the intermediate layer 16, the intermediate-temperature thermosensitive color development layer 15, the intermediate layer 14, and the low-temperature thermosensitive color development layer 13, and at the same time, is provided for arrangement of anti-counterfeit items such as a hologram, a lenticular lens, a microarray lens, and an ultraviolet excitation type fluorescent ink, and insertion of an internal protection item such as an ultraviolet cut layer or for use of both of these functions The thickness of the protective/functional layer 19 is set to 0.5 to 10 μm, and the thermal conductivity ratio thereof is 0.01 to 1 W/m/K, for example.

The light absorption characteristics of the photothermal conversion layers 18, the high-temperature thermosensitive color development layer 17, the intermediate layer 16, the intermediate-temperature thermosensitive color development layer 15, the intermediate layer 14, the low-temperature thermosensitive color development layer 13, and the protective/functional layer 19 will be described in detail.

FIG. 4 is an explanatory graph of an example of the light absorption characteristics of the photothermal conversion layer.

As illustrated in FIG. 4, the photothermal conversion layer 18 has an infrared ray absorption characteristic having an absorption peak at a wavelength λ (fox example, λ=1064 nm) belonging to near infrared rays.

Meanwhile, the low-temperature thermosensitive color development layer 13, the intermediate layer 14, the intermediate-temperature thermosensitive color development layer 15, the intermediate layer 16, the high-temperature thermosensitive color development layer 17, and the protective/functional layer 19 are each formed of a material that transmits light having a wavelength λ belonging to near infrared rays (near infrared light). This is because light having a wavelength λ that can be absorbed by the light-absorption color development layer 12 or the photothermal conversion layer 18 (near infrared light) is made to reach.

Thus, when near infrared light having a wavelength λ (for example, λ=1064 nm) is incident from the protective/functional layer 19 side, in the full-color image area ARC, the near infrared light is transmitted through the protective/functional layer 19 to reach the photothermal conversion layers 18. The incident infrared light is almost absorbed by the photothermal conversion layers 18 and photo-thermally converted to cause the high-temperature thermosensitive color development layer 17, the intermediate-temperature thermosensitive color development layer 15, or the low-temperature thermosensitive color development layer 13 to develop color.

Meanwhile, in the monochrome image area ARM, the light transmits to the light-absorption color development layer through the protective/functional layer 19, the high-temperature thermosensitive color development layer 17, the intermediate layer 16, the intermediate-temperature thermosensitive color development layer 15, the intermediate layer 14, the low-temperature thermosensitive color development layer 13 in this order. The light-absorption color development layer 12 substantially absorbs the light to develop color.

Next, materials constituting each layer will be described.

First, the base material 11 will be described.

The base material 11 is generally used as a card, paper, a film material, and can be made of resin that can be processed into a film or a plate form, such as polyester resin, polyethylene terephthalate (PET), glycol-modified polyester (PET-G), polypropylene (PP), polycarbonate (PC), polyvinyl chloride (PVC), styrene butadiene copolymer (SBR), polyacrylic resin, polyurethane resin, or polystyrene resin.

Alternatively, the base material 11 may be the resin as above added with silica, titanium oxide, calcium carbonate, or alumina as a filler and having whiteness, surface smoothness, or heat insulation.

In addition, the base material 11 may be paper or sheet of paper and resin materials described in JP 3889431 B2, JP 4215817 B2, JP 4329744 B2, and JP 4391286 B2, for example.

Specifically, examples of the base material 11 include polyethylene terephthalate (A-PET, PETG), poly-1,4-cyclohexanedimethylene terephthalate (PCT), polystyrene (PS), polymethyl methacrylate (PMMA), transparent ABS (MABS), polypropylene (PP), polyethylene (PE), polyvinyl alcohol (PVA), styrene butadiene copolymer (SBR), acrylic resin, acrylic modified urethane resin, styrene/acrylic resin, ethylene/acrylic resin, urethane resin, rosin modified maleic resin, vinyl chloride/vinyl acetate copolymer, polyvinyl acetal resin, polyamide resin, cellulose resins such as hydroxyethyl cellulose, hydroxypropyl cellulose, and nitrocellulose, polyolefin resin, polyamide resin, biodegradable resin, cellulose resin, paper base materials, and metal materials.

The above resins and fillers are merely exemplary, and other materials can be used as long as they satisfy machining performance and functionality.

In the above configuration, it is preferable to use a white or transparent resin.

Herein, the term "transparent" means that the light transmittance in the visible light area is 30% or more on average.

Next, the low-temperature thermosensitive color development layer 13, the intermediate-temperature thermosensitive color development layer 15, and the high-temperature thermosensitive color development layer 17 will be described.

Examples of the low-temperature thermosensitive color development layer 13, the intermediate-temperature thermosensitive color development layer 15, and the high-temperature thermosensitive color development layer 17 include, for example, resins having high transparency such as polyvinyl alcohol, polyvinyl acetate, and polyacryl as a binder, and leuco dye, leuco pigment or a temperature indicating material, and a color developer as a color material that develops color at temperature over a certain threshold temperature.

Examples of the leuco dye and the leuco pigment or the temperature indicating material include color development dyes such as 3,3-bis(1-n-butyl-2-methyl-indol-3-yl)phthalide, 7-(1-butyl-2-methyl-1H-indole-3-yl)-7-(4-diethylamino-2-methyl-phenyl)-7H-furo[3,4-b]pyridin-5-one, 1-(2,4-dichloro-phenylcarbamoyl)-3,3-dimethyl-2-oxo-1-phenoxy-butyl]-(4-diethylamino-phenyl)-carbamic acid isobutyl ester, 3,3-bis (p-dimethylaminophenyl)phthalide, 3,3-bis(p-dimethylaminophenyl)-6-dimethylaminophthalide (also known as crystal violet lactone=CVL), 3,3-bis(p-dimethylaminophenyl)-6-aminophthalide, 3,3-bis(p-dimethylaminophenyl)-6-nitrophthalide, 3,3-bis-3-dimethylamino-7-methylfluorane, 3-diethylamino-7-chlorofluorane, 3-diethylamino-6-chloro-7-methylfluorane, 3-diethylamino-7-anilinofluorane, 3-diethylamino-6-methyl-7-anilinofluorane, 2-(2-fluorophenylamino)-6-diethylaminofluorane, 2-(2-fluorophenylamino)-6-di-n-butylaminofluorane, 3-piperidino-6-methyl-7-anilinofluorane, 3-(N-ethyl-p-toluidino)-7-(N-methylanilino)fluorane, 3-(N-ethyl-p-toluidino)-6-methyl-7-anilinofluorane, 3-N-ethyl-N-isoamylamino-6-methyl-7-anilinofluorane, 3-N-methyl-N-cyclohexylamino-6-methyl-7-anilinofluorane, 3-N,N-diethylamino-7-o-chloroanilinofluorane, rhodamine B lactam, 3-methylspirodinaphthopyran, 3-ethylspirodinaphthopyran, and 3-benzylspironaphthopyran.

The developer can be any acidic substance for use as an electron acceptor in a heat-sensitive recording Material.

Examples of the developer include inorganic substances such as activated clay and acidic clay, inorganic acids, aromatic carboxylic acids, anhydrides or metal salts thereof, organic sulfonic acids, other organic acids, and organic developers such as phenolic compounds, and phenolic compounds are preferable.

Examples of the developer specifically include bis-3-allyl-4-hydroxyphenylsulfone, polyhydroxystyrene, zinc salt of 3,5-di-t-butylsalicylic acid, zinc salt of 3-octyl-5-methylsalicylic acid, phenol, 4-phenylphenol, 4-hydroxyacetophenone, 2,2'-dihydroxydiphenyl, 2,2'-methylenebis(4-chlorophenol), 2,2'-methylenebis(4-methyl-6-t-butylphenol), 4,4'-isopropylidenediphenol (also known as bisphenol A), 4,4'-isopropylidenebis(2-chlorophenol), 4,4'-isopropylidenebis(2-methylphenol), 4,4' ethylenebis(2-methylphenol), 4,4'-thiobis(6-t-butyl-3-methylphenol), 1,1-bis(4-hydroxyphenyl)-cyclohexane, 2,2'-bis(4-hydroxyphenyl)-n-heptane, phenolic compounds such as 4,4'-cyclohexylidenebis(2-isopropylphenol), and 4,4'-sulfonyl diphenol, salts of the phenolic compounds, salicylic acid anilide, novolak type phenol resins, and p-hydroxybenzoate benzyl.

Examples of the intermediate layer 14 and the intermediate layer 16 include polypropylene (PP), polyvinyl alcohol (PVA), styrene butadiene copolymer (SBR), polystyrene, or polyacryl.

Next, the photothermal conversion layers 18 will be described.

The photothermal conversion layer 18 includes a light-absorbing heat generating agent that transmits visible light and absorbs infrared light and binder resin, which are mixed and applied in a solvent so that the mass ratio of the solid content thereof becomes such that the infrared ray absorbing heat generating agent: the binder resin=1-20: 99-80.

The film thickness when the photothermal conversion layer 18 is applied is preferably 1 to 10 μm, more preferably 1 to 5 μm.

Examples of the infrared ray absorbing heat generating agent contained in the photothermal conversion layer 18 include polymethine cyanine pigment, polymethine pigment, squarylium pigment, porphyrin pigment, metal dithiol complex pigment, phthalocyanine pigment, diimonium pigment, inorganic oxide particle, azo pigment, naphthoquinone and anthraquinone quinone pigment, cerium oxide, indium tin oxide, tin antimony oxide, cesium tungsten oxide, and lanthanum hexaboride.

Examples of the binder resin contained in the photothermal conversion layer 18 include nitrocellulose, cellulose phosphate, cellulose sulfate, cellulose propionate, cellulose acetate, cellulose propionate, cellulose palmitate, cellulose myristate, cellulose acetate butyrate, cellulose esters such as cellulose acetate propionate, polyester resin, hydroxyethyl cellulose, hydroxypropyl cellulose, ethyl cellulose, methyl cellulose, and cellulose resin such as cellulose acetate.

Examples of the binder resin contained in the photothermal conversion layer 18 include vinyl resins such as polyvinyl alcohol, polyvinyl acetate, polyvinyl butyral, polyvinyl acetal, polyacrylamide, acrylic resins such as polymethyl acrylate and polyacrylic acid, polyethylene, polyolefins such as polypropylene, polyacrylate resins, epoxy resins, and phenol resins.

In particular, PET resin, PETG, PVC resin, PVA resin, PC resin, PP resin, PE resin, ABS resin, polyamide resin, and vinyl acetate resin are representative thereof. Examples of the photothermal conversion layer 18 include a copolymer containing these resins as the base or a material containing an additive such as silica, calcium carbonate, titanium oxide, or carbon.

The protective/functional layer 19 may be provided as necessary, and can specifically functions to insert anti-counterfeit items such as a hologram, a lenticular lens, a microarray lens, and an ultraviolet excitation fluorescent ink, and/or insert an internal protection item such as an ultraviolet cut layer. The protective/functional layer 19 is preferably colorless and transparent to allow visual check of color recording and monochrome recording under the protective/functional layer 19 after the recording.

Next, a laser recording device of the first embodiment will be described.

Figure 5:
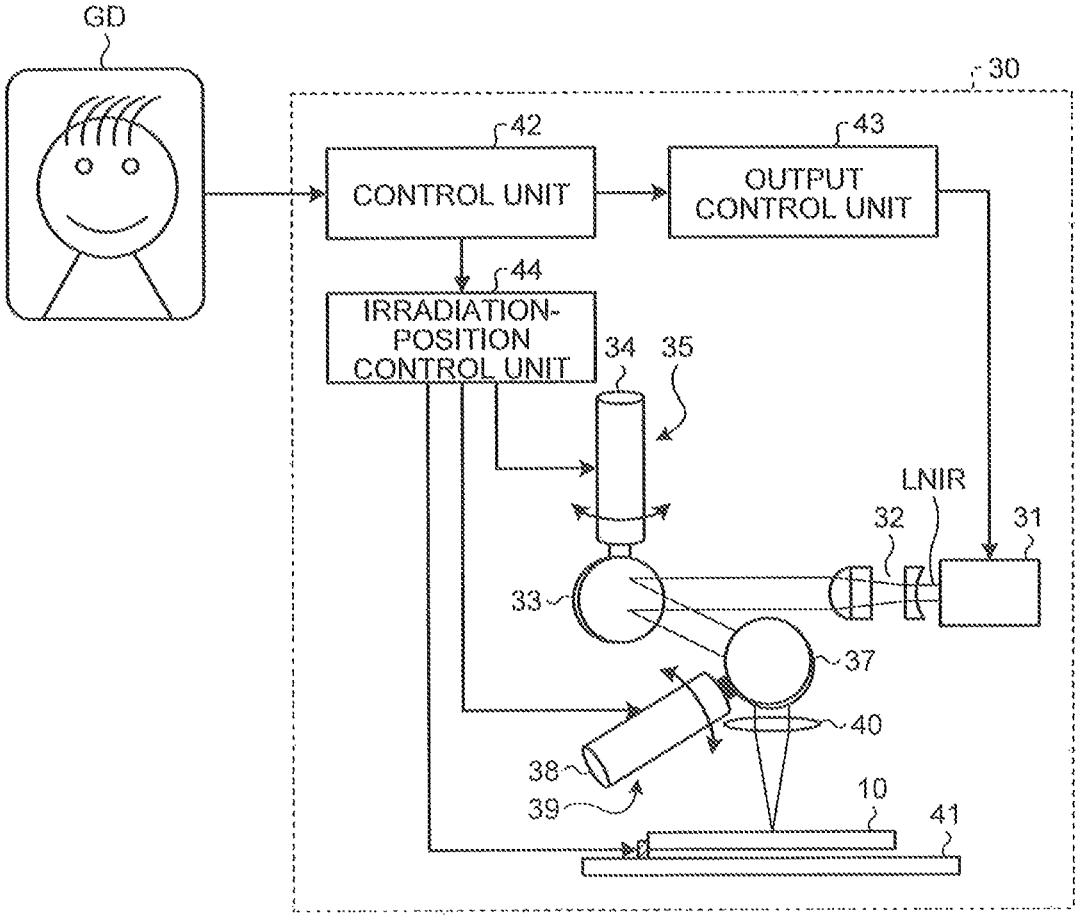
FIG. 5 is a schematic configuration block diagram of a laser recording device in the first embodiment.

FIG. 5 is a schematic configuration block diagram of the laser recording device of the first embodiment.

A laser recording device 30 of the first embodiment includes a laser oscillator 31 that outputs near-infrared laser light LNIR (=wavelength λ), a beam expander 32 that expands the beam diameter of the near-infrared laser light LNIR, a first-direction scanning unit 35 including a first motor 34 that drives a first-direction scan mirror 33 in order to drive the first-direction scan mirror 33 that reflects the near-infrared laser light LNIR and scan the near-infrared laser light LNIR in the first direction, a second-direction scanning unit 39 including a second motor 38 that drives a second-direction scan mirror 37 in order to drive the second-direction scan mirror 36 that reflects the near-infrared laser light LNIR and scan the near-infrared laser light LNIR in a second direction orthogonal to the first direction, a condenser lens (F/θ lens) 40 that condenses the near-infrared laser light LNIR guided through the first-direction scanning unit 35 and the second-direction scanning unit 39 to the recording medium 10, a stage 41 that conveys the recording medium 10 to a given position and retains it, a control unit 42 that calculates the irradiation position and irradiation intensity of far-infrared laser light LFIR based on the input image data GD and controls the entire laser recording device 30, an output control unit 43 that controls laser output of the laser oscillator 31 based on the calculation result of the control unit 42, and an irradiation-position control unit 44 that controls the first motor 34 and the second motor 38 based on the calculation result of the control unit 42 and controls the irradiation position of the near-infrared laser light LNIR on the recording medium 10.

In the above configuration, examples of the laser oscillator 31 include near-infrared layers such as a semiconductor laser, a fiber laser, a YAG laser, or a YVO4 laser.

Next, a recording process on the recording medium 10 in the laser recording device 30 will be described.

Figure 6:
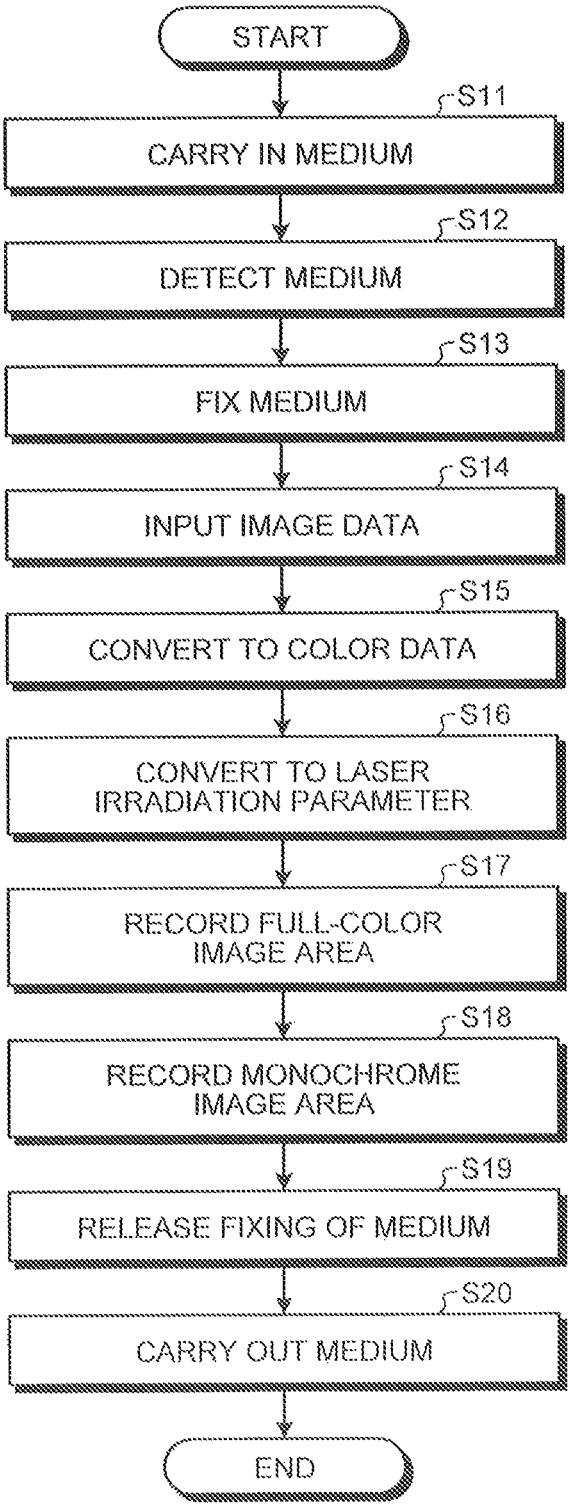
FIG. 6 is an operation flowchart of the laser recording device.

FIG. 6 is an operation flowchart of the laser recording device.

In the following, the light-absorption color development layer 12 is a black (K) color development layer, the low-temperature thermosensitive color development layer 13 is a cyan (C) color development layer, the intermediate-temperature thermosensitive color development layer 15 is a magenta (M) color development layer, and the high-temperature thermosensitive color development layer 17 is a yellow (Y) color development layer.

First, the control unit 42 of the laser recording device 30 carries in the recording medium 10 to the recording position through a conveying device (not illustrated) (step S11).

Subsequently, the control unit 42 of the laser recording device 30 detects the recording medium 10 carried in by a sensor (not illustrated) (step S12), and fixes the recording medium 10 at a given carrying-in position by a fixing device (not illustrated) (step S13).

In response to input of the input image data GD as RGB data (step S14), the control unit 42 of the laser recording device 30 analyzes the input image data GD and converts it into color data (CMYK data) on a pixel basis (step S15.

The control unit 42 converts the color data for each pixel into a laser-irradiation parameter value according to the combination of intended layers for color development (step S16).

The laser-irradiation parameter value specifically represents a set power value, a set scanning-speed value, a set pulse-width value, a set irradiation repetition-number value, or a set scanning-pitch value.

Subsequently, the control unit 42 controls the output control unit 43 and the irradiation-position control unit 44, and performs image recording on the full-color image area ARC using the near-infrared laser light LNIR based on the laser-irradiation parameter value set in step S13 in order to cause the high-temperature thermosensitive color development layer 17, the intermediate-temperature thermosensitive color development layer 15, and the low-temperature thermosensitive color development layer 13 to develop color (step S17).

The color development control in the full-color image area ARC will be now described.

In the full-color image area ARC, the laser recording device 30 performs color development using the high-temperature thermosensitive color development layer 17, the intermediate-temperature thermosensitive color development layer 15, and the low-temperature thermosensitive color development layer 13.

As described above, the high-temperature thermosensitive color development layer 17 develops color when its temperature becomes equal to or higher than the first threshold temperature T1, the intermediate-temperature thermosensitive color development layer 15 develops color when its temperature becomes equal to or higher than the second threshold temperature T2 (<T1), and the low-temperature thermosensitive color development layer 13 develops color when its temperature becomes equal to or higher than the third threshold temperature T3 (<T2<T1).

More specifically, for example, the setting is made so that the first threshold temperature T1 corresponding to the high-temperature thermosensitive color development layer 17=150 to 270° C., the second threshold temperature T2 corresponding to the intermediate-temperature thermosensitive color development layer 15=100 to 200° C., and the third threshold temperature T3 corresponding to the low-temperature thermosensitive color development layer 13=60 to 140° C., and that the above relationship is satisfied.

First, the color development control of the high-temperature thermosensitive color development layer 17 alone will be described.

Figure 7:
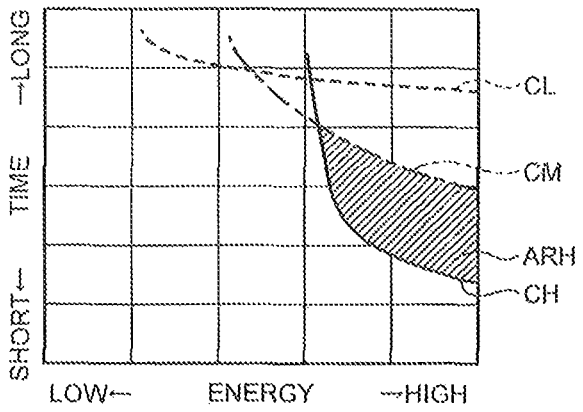
FIG. 7 is a graph for explaining the relationship between the energy of laser light and the irradiation time when a high-temperature thermosensitive color development layer is caused to develop color alone.

FIG. 7 is a graph for explaining the relationship between the energy of the laser light and the irradiation time when the high-temperature thermosensitive color development layer is caused to develop color alone.

As illustrated in FIG. 7, the high-temperature thermosensitive color development layer 17 develops color in the upper right area of the corresponding color development curve CH (the color development area of the high-temperature thermosensitive color development layer 17). Further, the intermediate-temperature thermosensitive color development layer 15 develops color in the upper right area of the corresponding color development curve CM (the color development area of the intermediate-temperature thermosensitive color development layer 15). Moreover, the low-temperature thermosensitive color development layer 13 develops color in the upper right area of the corresponding color development curve CL (the color development area of the low-temperature thermosensitive color development layer 13).

Thus, when the high-temperature thermosensitive color development layer 17 is caused to develop color alone, the energy of the laser light and the irradiation time may be set so as to belong to the color development area of the high-temperature thermosensitive color development layer 17, the non-color development area of the intermediate-temperature thermosensitive color development layer 15, and the non-color development area of the low-temperature thermosensitive color development layer 13, as in the area ARH indicated by hatching in FIG. 7.

The color development control of the high-temperature thermosensitive color development layer 17 will be described in more detail.

Figure 8:
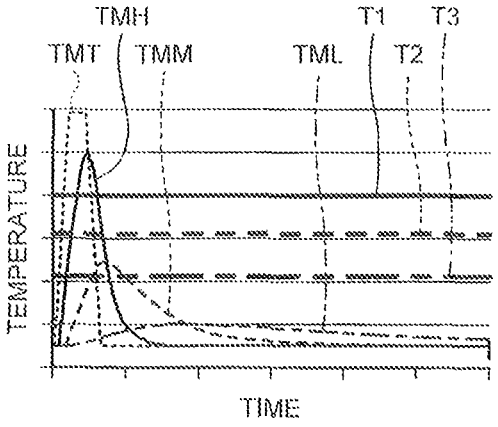
FIG. 8 is an explanatory graph of the color development control temperature of the high-temperature thermosensitive color development layer.

FIG. 8 is an explanatory graph of the color development control temperature of the high-temperature thermosensitive color development layer.

When the high-temperature thermosensitive color development layer 17 is caused to develop color, it is necessary to generate heat in the photothermal conversion layer 18 and to transfer heat necessary for color development to the high-temperature thermosensitive color development layer 17.

For this purpose, as illustrated in FIG. 8, the laser-irradiation parameter value may be set so that the temperature TMH of the high-temperature thermosensitive color development layer 17 exceeds the first threshold temperature T1, the temperature TMM of the intermediate-temperature thermosensitive color development layer 15 does not exceed the second threshold temperature T2, and the temperature TML of the low-temperature thermosensitive color development layer 13 does not exceed the third threshold temperature T3, the near-infrared laser light LNIR may be irradiated, and the temperature TMT of the photothermal conversion layer 18 may be controlled.

Then, the near-infrared laser light LNIR passes through the protective/functional layer 19, the low-temperature thermosensitive color development layer 13, the intermediate layer 14, the intermediate-temperature thermosensitive color development layer 15, the intermediate layer 16, the high-temperature thermosensitive color development layer 17, and the intermediate layer 14 to reach the photothermal conversion layers 18.

In this case, as illustrated in FIG. 8, a laser-irradiation parameter value of the near-infrared laser light LNIR emitted to the photothermal conversion layer 18 is set such that the heat generation amount rapidly increases and the heat generation time shortens.

Thus, the photothermal conversion layer 18 absorbs the near-infrared laser light LNIR, performs light-heat conversion, and generates heat rapidly, and the temperature TMT of the photothermal conversion layer 18 changes as illustrated in FIG. 8.

Along with this, the temperature of the high-temperature thermosensitive color development layer 17 closer to the photothermal conversion layer 18 rapidly increases and exceeds the first threshold temperature T1, and the high-temperature thermosensitive color development layer 17 develops yellow (Y).

Meanwhile, heat from the photothermal conversion layer 18 is conducted to the intermediate-temperature thermosensitive color development layer 15 through the intermediate layer 14, the high-temperature thermosensitive color development layer 17, and the intermediate layer 16, and further conducted to the low-temperature thermosensitive color development layer 13 through the intermediate layer 14. However, as illustrated in FIG. 8, the time during which heat is conducted is short, and the amount of heat (heat energy) transferred to the intermediate-temperature thermosensitive color development layer 15 and the low-temperature thermosensitive color development layer 13 is small. Thus, the temperature rise of the temperature TMM of the intermediate-temperature thermosensitive color development layer 15 and the temperature TML of the low-temperature thermosensitive color development layer 13 is small.

Thus, as illustrated in FIG. 8, the temperature TMM of the intermediate-temperature thermosensitive color development layer 15 does not exceed the second threshold temperature T2, and the intermediate-temperature thermosensitive color development layer 15 does not develop color.

Similarly, as illustrated in FIG. 8, the temperature TML of the low-temperature thermosensitive color development layer 13 does not exceed the third threshold temperature T3, thus, the low-temperature thermosensitive color development layer 13 does not develop color.

Further, the near-infrared laser light LNIR is absorbed by the photothermal conversion layer 18 and does not reach the light-absorption color development layer 12, so that the light-absorption color development layer 12 does not develop color either.

Next, the color development control of the intermediate-temperature thermosensitive color development layer 15 alone will be described.

Figure 9:
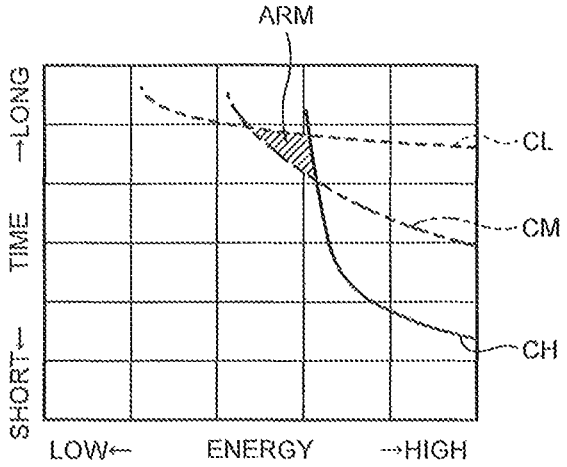
FIG. 9 is a graph for explaining the relationship between the energy of laser light and the irradiation time when an intermediate-temperature thermosensitive color development layer is caused to develop color alone.

FIG. 9 is a graph for explaining the relationship between the energy of the laser light and the irradiation time when the intermediate-temperature thermosensitive color development layer is caused to develop color alone.

As the high-temperature thermosensitive color development layer 17, when the intermediate-temperature thermosensitive color development layer 15 is caused to develop color alone, the energy of the laser light and the irradiation time may be set so as to belong to the color development area of the intermediate-temperature thermosensitive color development layer 15, the non-color development area of the high-temperature thermosensitive color development layer 17, and the non-color development area of the intermediate-temperature thermosensitive color development layer 15, as in the area ARM indicated by hatching in FIG. 9.

The color development control of the intermediate-temperature thermosensitive color development layer 15 will be described in more detail.

Figure 10:
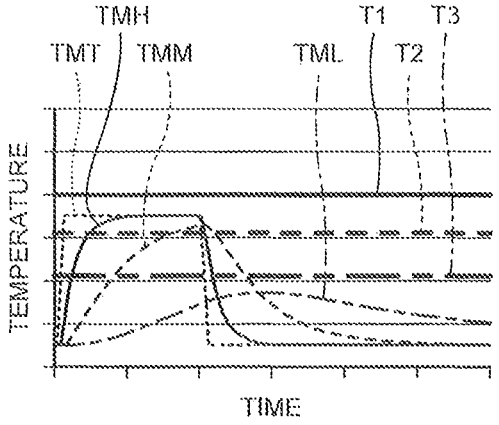
FIG. 10 is an explanatory graph of the color development control temperature of the intermediate-temperature thermosensitive color development layer.

FIG. 10 is an explanatory graph of the color development control temperature of the intermediate-temperature thermosensitive color development layer.

Even when the intermediate-temperature thermosensitive color development layer 15 is caused to develop color, it is necessary to generate heat in the photothermal conversion layer 18 and to transfer heat necessary for color development to the intermediate-temperature thermosensitive color development layer 15 through the high-temperature thermosensitive color development layer 17 and the intermediate layer 16 without causing the high-temperature thermosensitive color development layer 17 to develop color.

For this purpose, as illustrated in FIG. 10, the laser-irradiation parameter value may be set so that the temperature of the intermediate-temperature thermosensitive color development layer 15 exceeds the second threshold temperature T2, the temperature of the high-temperature thermosensitive color development layer 17 does not exceed the first threshold temperature T1, and the temperature of the low-temperature thermosensitive color development layer 13 does not exceed the third threshold temperature T3, the near-infrared laser light LNIR may be irradiated, and the temperature TMT of the photothermal conversion layer 18 may be controlled.

Then, the near-infrared laser light LNIR passes through the protective/functional layer 19, the low-temperature thermosensitive color development layer 13, the intermediate layer 14, the intermediate-temperature thermosensitive color development layer 15, the intermediate layer 16, the high-temperature thermosensitive color development layer 17, and the intermediate layer 14 to reach the photothermal conversion layers 18.

In this case, a laser-irradiation parameter value of the near-infrared laser light LNIR emitted to the photothermal conversion layers 18 is set such that the heat generation amount gradually increases and the heat generation time elongates, as compared with the high-temperature thermosensitive color development layer 17 being the one to develop color.

Thus, the photothermal conversion layer 18 absorbs the near-infrared laser light LNIR, performs light-heat conversion, and generates heat gradually, and the temperature TMT of the photothermal conversion layer 18 changes as illustrated in FIG. 10.

Along with this, the temperature of the high-temperature thermosensitive color development layer 17 closer to the photothermal conversion layer 18 increases, but does not exceed the first threshold temperature T1, and the high-temperature thermosensitive color development layer 17 does not develop yellow (Y).

Meanwhile, heat from the photothermal conversion layer 18 is conducted to the intermediate-temperature thermosensitive color development layer 15 through the intermediate layer 14, the high-temperature thermosensitive color development layer 17, and the intermediate layer 16, and further, the heat is conducted to the low-temperature thermosensitive color development layer 13 through the intermediate layer 14.

At this time, as illustrated in FIG. 10, the time during which heat is conducted is longer than when the high-temperature thermosensitive color development layer 17 is caused to develop color and the temperature is lower, but the second threshold temperature T2 at which the intermediate-temperature thermosensitive color development layer 15 develops color is lower than the first threshold temperature T1. Thus, sufficient energy necessary for color development is transmitted to the intermediate-temperature thermosensitive color development layer 15.

Thus, the temperature of the intermediate-temperature thermosensitive color development layer 15 exceeds the second threshold temperature T2, and the intermediate-temperature thermosensitive color development layer 15 develops magenta (M).

At this time, the low-temperature thermosensitive color development layer 13 is located far from the photothermal conversion layer 18, and the amount of heat (heat energy) transferred is small, so that the temperature rise of the low-temperature thermosensitive color development layer 13 is small.

Thus, the temperature of the low-temperature thermosensitive color development layer 13 does not exceed the third threshold temperature T3, thus, the low-temperature thermosensitive color development layer 13 does not develop color.

Further, the near-infrared laser light LNIR is absorbed by the photothermal conversion layer 18 and does not reach the light-absorption color development layer 12, so that the light-absorption color development layer 12 does not develop color either.

Next, the color development control of the low-temperature thermosensitive color development layer 13 alone will be described.

Figure 11:
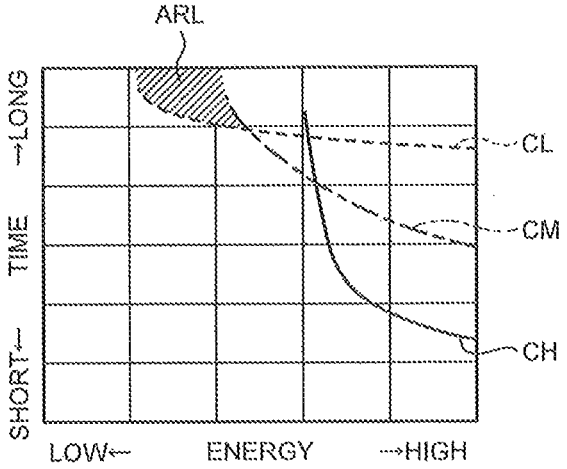
FIG. 11 is a graph for explaining the relationship between the energy of laser light and the irradiation time when a low-temperature thermosensitive color development layer is caused to develop color alone.

FIG. 11 is a graph for explaining the relationship between the energy of the laser light and the irradiation time when the low-temperature thermosensitive color development layer is caused to develop color alone.

As the high-temperature thermosensitive color development layer 17, to develop color by the low-temperature thermosensitive color development layer 13 alone, the energy of the laser light and the irradiation time can be simply set so as to fall in the color development area of the low-temperature thermosensitive color development layer 13, the non-color development area of the high-temperature thermosensitive color development layer 17, and the non-color development area of the intermediate-temperature thermosensitive color development layer 15, as in the area ARL indicated by hatching in FIG. 11.

The color development control of the low-temperature thermosensitive color development layer 13 will be described in more detail.

Figure 12:
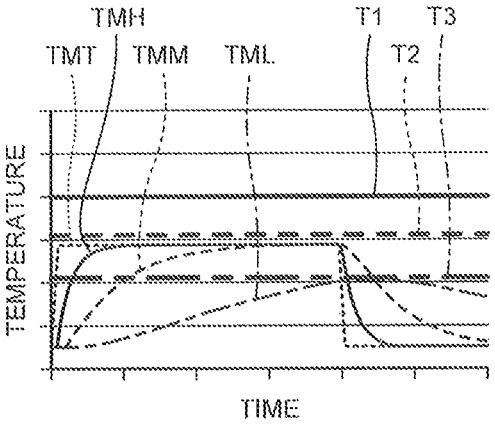
FIG. 12 is an explanatory graph of the color development control temperature of the low-temperature thermosensitive color development layer.

FIG. 12 is an explanatory graph of the color development control temperature of the low-temperature thermosensitive color development layer.

In this case, the near-infrared laser light LNIR irradiated to the photothermal conversion layers 18 has a laser-irradiation parameter value set so that the heat generation amount more gradually increases and the heat generation time further elongates, as compared with the intermediate-temperature thermosensitive color development layer 15 being the one to develop color.

Thus, the photothermal conversion layer 18 absorbs the near-infrared laser light LNIR, performs light-to-heat conversion, and generates heat more gradually. Thus, the temperature of the high-temperature thermosensitive color development layer 17 closer to the photothermal conversion layer 18 does not exceed the first threshold temperature T1, and the high-temperature thermosensitive color development layer 17 does not develop yellow (Y).

Heat from the photothermal conversion layer 18 is transferred to the intermediate-temperature thermosensitive color development layer 15 through the high-temperature thermosensitive color development layer 17 and the intermediate layer 16.

In this case, as illustrated in FIG. 12, the heat transfer time is longer than that for color development of the intermediate-temperature thermosensitive color development layer 15. However, the lower temperature of the intermediate-temperature thermosensitive color development layer 15 does not exceed the second threshold temperature T2, and the high-temperature thermosensitive color development layer 17 does not develop magenta (M).

Further, heat is conducted from the photothermal conversion layers 18 to the low-temperature thermosensitive color development layer 13 through the intermediate layer 14, the high-temperature thermosensitive color development layer 17, the intermediate layer 16, the intermediate-temperature thermosensitive color development layer 15, and the intermediate layer 14.

At this time, the low-temperature thermosensitive color development layer 13 is located far from the photothermal conversion layers 18. However, as illustrated in FIG. 12, the time during which heat is conducted is longer than when the intermediate-temperature thermosensitive color development layer 15 is caused to develop color, and the temperature is lower, but the third threshold temperature T3 at which the low-temperature thermosensitive color development layer 13 develops color is further lower. Thus, sufficient energy necessary for color development is transmitted to the low-temperature thermosensitive color development layer 13.

Thus, the temperature of the low-temperature thermosensitive color development layer 13 exceeds the third threshold temperature T3, and the low-temperature thermosensitive color development layer 13, develops cyan (C) in the full-color image area ARC.

The above embodiment has described the example that the high-temperature thermosensitive color development layer 17, the intermediate-temperature thermosensitive color development layer 15, and the low-temperature thermosensitive color development layer 13 are each independently caused to develop color. However, it is also possible to develop two or three colors simultaneously.

Hereinafter, development of a plurality of colors will be described.

Figure 13:
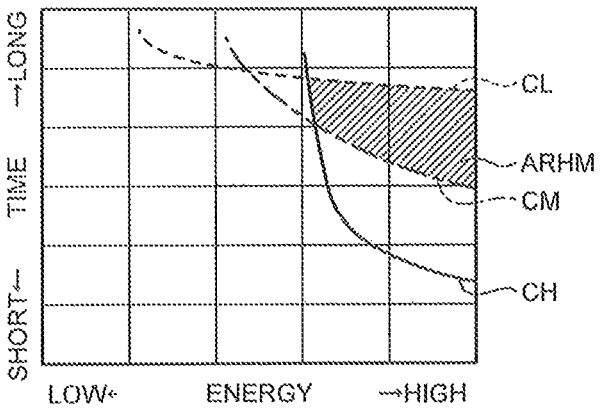
FIG. 13 is a graph for explaining the relationship between the energy of laser light and the irradiation time when the high-temperature thermosensitive color development layer and the intermediate-temperature thermosensitive color development layer are caused to develop color in parallel.

FIG. 13 is a graph for explaining the relationship between the energy of the laser light and the irradiation time when the high-temperature thermosensitive color development layer and the intermediate-temperature thermosensitive color development layer are caused to develop color in parallel.

When the high-temperature thermosensitive color development layer 17 and the intermediate-temperature thermosensitive color development layer 15 are caused to develop color in parallel, it is only necessary that the energy of the laser light and the irradiation time be set so as to belong to the area belonging to the color development area of the high-temperature thermosensitive color development layer 17, the color development area of the intermediate-temperature thermosensitive color development layer 15, and the non-color development area of the low-temperature thermosensitive color development layer 13, as in the area ARHM indicated by hatching in FIG. 13.

By controlling in this way, color development of yellow (Y) corresponding to the high-temperature thermosensitive color development layer 17 and color development of magenta (M) corresponding to the intermediate-temperature thermosensitive color development layer 15 are caused, resulting in color development of red in the full-color image area ARC.

Figure 14:
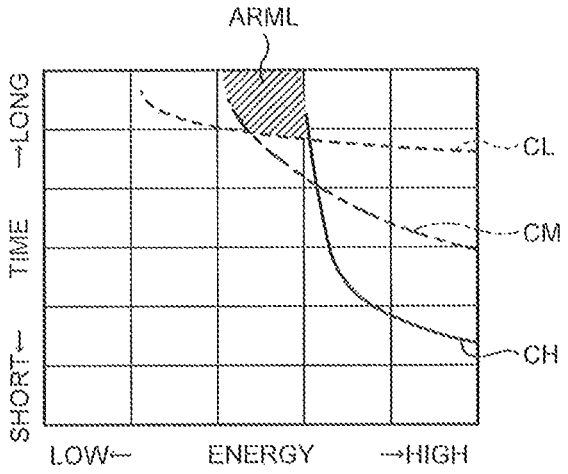
FIG. 14 is a graph for explaining the relationship between the energy of laser light and the irradiation time when the intermediate-temperature thermosensitive color development layer and the low-temperature thermosensitive color development layer are caused to develop color in parallel.

FIG. 14 is a graph for explaining the relationship between the energy of the laser light and the irradiation time when the intermediate-temperature thermosensitive color development layer and the low-temperature thermosensitive color development layer are caused to develop color in parallel.

When the intermediate-temperature thermosensitive color development layer 15 and the low-temperature thermosensitive color development layer 13 are caused to develop color in parallel, it is only necessary that the energy of the laser light and the irradiation time be set so as to belong to the color development area of the intermediate-temperature thermosensitive color development layer 15, the color development area of the low-temperature thermosensitive color development layer 13, and the non-color development area of the high-temperature thermosensitive color development layer 17, as in the area ARML indicated by hatching in FIG. 14.

By controlling in this way, color development of magenta (M) corresponding to the intermediate-temperature thermosensitive color development layer 15 and color development of cyan (C) corresponding to the low-temperature thermosensitive color development layer 13 are caused, resulting in color development of blue in the full-color image area ARC.

Figure 15:
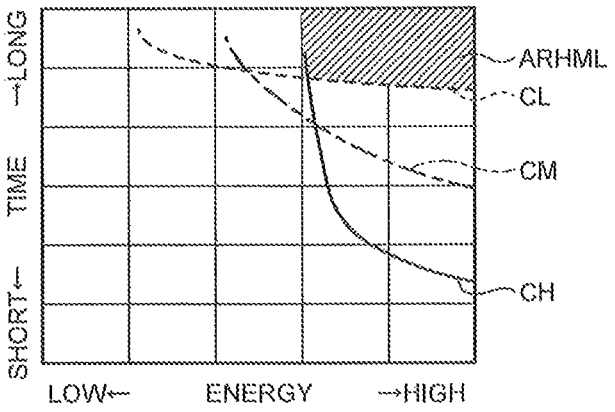
FIG. 15 is a graph for explaining the relationship between the energy of laser light and the irradiation time when the high-temperature thermosensitive color development layer, the intermediate-temperature thermosensitive color development layer, and the low-temperature thermosensitive color development layer are caused to develop color in parallel.

FIG. 15 is a graph for explaining the relationship between the energy of the laser light and the irradiation time when the high-temperature thermosensitive color development layer, the intermediate-temperature thermosensitive color development layer, and the low-temperature thermosensitive color development layer are caused to develop color in parallel.

When the high-temperature thermosensitive color development layer 17, the intermediate-temperature thermosensitive color development layer 15, and the low-temperature thermosensitive color development layer 13 are caused to develop color in parallel, it is only necessary that the energy of the laser light and the irradiation time be set so as to belong to the color development area of the high-temperature thermosensitive color development layer 17, the color development area of the intermediate-temperature thermosensitive color development layer 15, and the color development area of the low-temperature thermosensitive color development layer 13, as in the area ARHML indicated by hatching in FIG. 12.

By controlling in this way, color development of yellow (Y) corresponding to high-temperature thermosensitive color development layer 17, color development of magenta (M) corresponding to the intermediate-temperature thermosensitive color development layer 15, and color development of cyan (C) corresponding to the low-temperature thermosensitive color development layer 13 are caused, resulting in color development of black (dark gray) in the full-color image area ARC.

Next, the color development control in the monochrome image area ARM will be described.

When the recording in the full-color image area ARC ends, the control unit 42 controls the output control unit 43 and the irradiation-position control unit 44, and performs image recording on the monochrome image area ARM using the near-infrared laser light LNIR based on the laser-irradiation parameter value set in step S13 in order to cause the light-absorption color development layer 12 to develop color (step S18).

In this case, the near-infrared laser light LNIR passes through the protective/functional layer 19, the high-temperature thermosensitive color development layer 17, the intermediate layer 16, the intermediate-temperature thermosensitive color development layer 15, the intermediate layer 14, and the low-temperature thermosensitive color development layer 13 to reach the light-absorption color development layer 12 without passing through the photothermal conversion layers 18. That is, the near-infrared laser light LNIR reaches the light-absorption color development layer 12 without being absorbed by the photothermal conversion layers 18.

As a result, the pigment particles contained in the light-absorption color development layer 12 absorb the near-infrared laser light LNIR for recording and are carbonized, thereby irreversibly developing black color.

The black color developed by the light-absorption color development layer 12 is a black color having a higher contrast than the black (dark gray) developed in the full-color image area ARC, so that images such as characters can be displayed more clearly.

Subsequently, the control unit 42 of the laser recording device 30 controls a fixing device (not illustrated) to release the recording medium 10 (step S19), carries out the recording medium 10 to a given carrying-out position through a conveying device (not illustrated), and ends the process (step S20).

As described above, according to the first embodiment, full-color/monochrome image recording can be performed using a single-wavelength laser light source. Furthermore, according to the first embodiment, additional writing cannot be performed using a thermal head or the like, the falsification of the recording medium can be prevented, and security can be improved.

Second Embodiment

Next, a recording medium of a second embodiment will be described.

Figure 16:
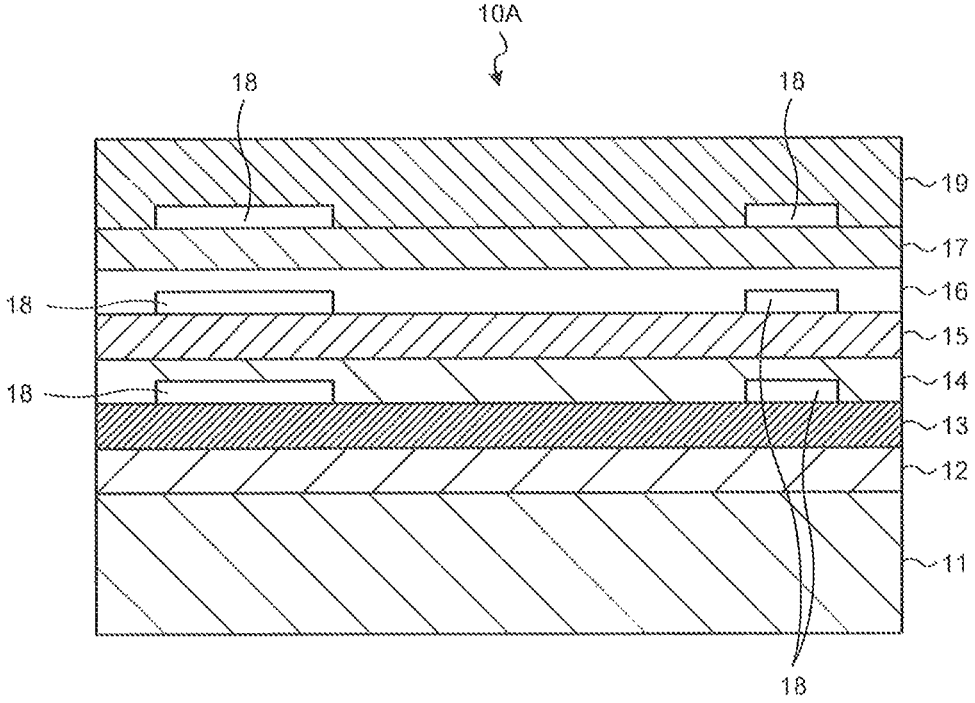
FIG. 16 is a cross-sectional view of a configuration example of a recording medium according to a second embodiment.

FIG. 16 is a cross-sectional view of a configuration example of the recording medium of the second embodiment.

A recording medium 10A of the second embodiment is different from the recording medium. 10 of the first embodiment in that the photothermal conversion layers 18 are arranged close not only to the high-temperature thermosensitive color development layer 17 but also to the intermediate-temperature thermosensitive color development layer 15 and the low-temperature thermosensitive color development layer 13. In this case, in order that the near-infrared laser light LNIR is more surely able to reach the photothermal conversion layers 18 arranged closer to the intermediate-temperature thermosensitive color development layer 15 and the low-temperature thermosensitive color development layer 13, the thickness of the photothermal conversion layers 18 is set thinner than the photothermal conversion layers 18 in FIG. 2 so as to partially transmit the other photothermal conversion layers 18 located on the incident side of the near-infrared laser light LNIR.

According to this configuration, in addition to the effects of the first embodiment, heat transfer loss can be reduced when the heat generated in the photothermal conversion layers 18 is transferred to the intermediate-temperature thermosensitive color development layer 15 and the low-temperature thermosensitive color development layer 13 side, and in addition, transmission loss of near-infrared laser light LNIR to the photothermal conversion layers 18 can also be reduced, so that further energy saving can be realized.

Third Embodiment

Figure 17A:
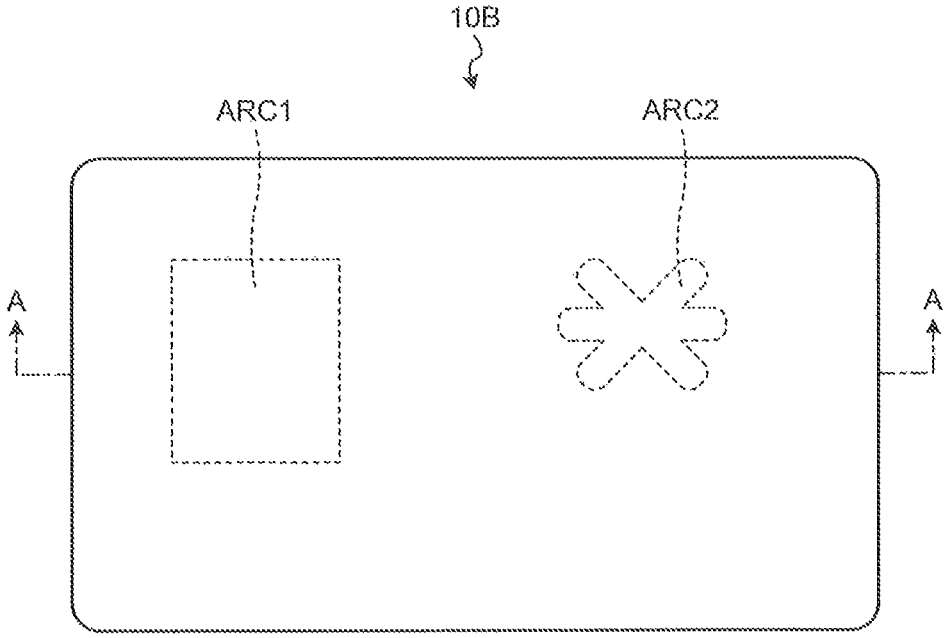
FIGS. 17A and 17B are explanatory views of a recording medium according to a third embodiment.
Figure 17B:
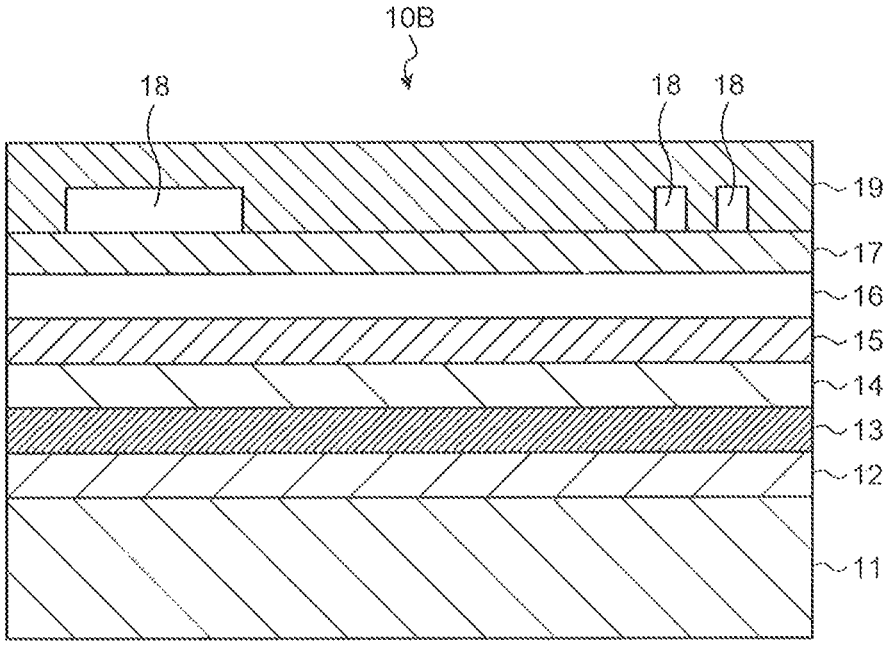

FIGS. 17A and 17B are explanatory views of a recording medium of a third embodiment.

FIG. 17A is a plan view, and FIG. 17B is a cross-sectional view taken along the line A-A in FIG. 17A.

In each of the embodiments described above, the photothermal conversion layer 18 for forming the full-color image area ARC has a square shape (rectangular shape in FIG. 20) in plan view like a full-color image area ARC1. However, the present invention is not limited thereto, and it is possible to employ a freely-selectable shape like a full-color image area ARC2 in a recording medium 10AB of the third embodiment illustrated in FIGS. 17A and 17B.

The freely-selectable shape may be a desired shape such as a circle, an ellipse, a polygon, a star, an animal shape, a map shape, or a human figure shape.

In this case, the photothermal conversion layer 18 is preferably formed on a recording medium 10B by printing. Examples of printing include general printing methods such as inkjet printing, offset printing, letterpress printing, screen printing, or intaglio printing.

According to the third embodiment, for example, authenticity determination can be facilitated by changing the shape for each issuance time of recording mediums.

Fourth Embodiment

Figure 18:
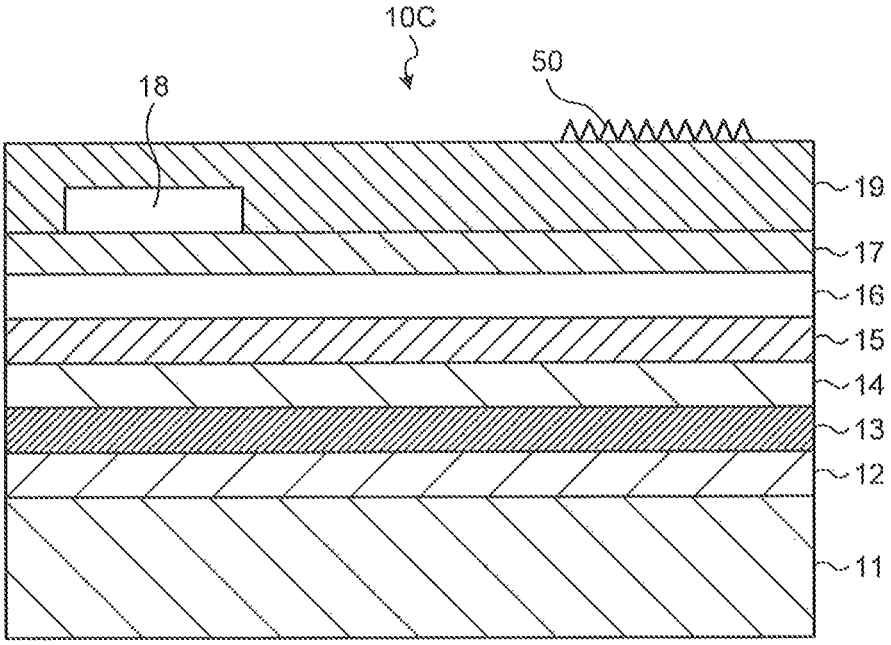
FIG. 18 is an explanatory view of a recording medium according to a fourth embodiment.

FIG. 18 is an explanatory view of a recording medium of a fourth embodiment.

A recording medium 10C of the fourth embodiment is different from the above embodiments in that a lenticular lens 50 is provided on the protective/functional layer 19 or integrally with the protective/functional layer 19.

With this configuration, it is possible to perform image formation on the recording medium 10C while changing the irradiation direction of the near-infrared laser light LNIR at the time of image formation, and to switch the image displayed depending on the viewing angle.

In the example of FIG. 18, since the lenticular lens 50 is provided in an area corresponding to the monochrome image area ARM where the photothermal conversion layer 18 is not provided, a recordable image is a monochrome image.

Figure 19:
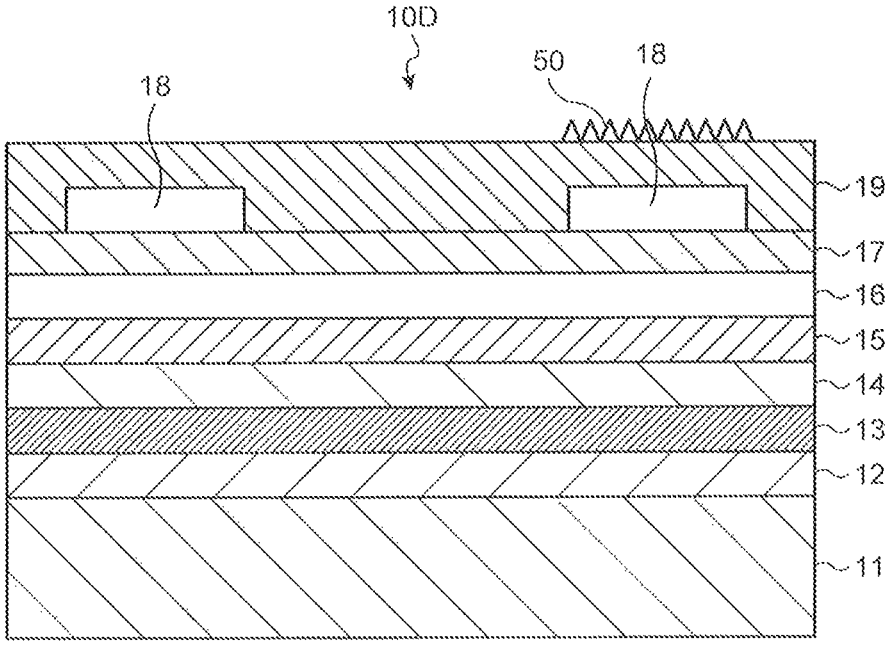
FIG. 19 is an explanatory view of a modification of the recording medium in the fourth embodiment.

FIG. 19 is an explanatory view of a modification of the recording medium of the fourth embodiment.

A recording medium 10D of the modification of the fourth embodiment is different from the fourth embodiment in that the photothermal conversion layer 18 is provided in the recordable area of the lenticular lens 50 as illustrated in FIG. 19, so that a full-color image is formed.

According to the fourth embodiment and the modification thereof, it is possible to improve the functionality of the recording medium, to make it difficult to forge the recording medium, and to easily determine the authenticity of the recording medium.

Fifth Embodiment

Figure 20:
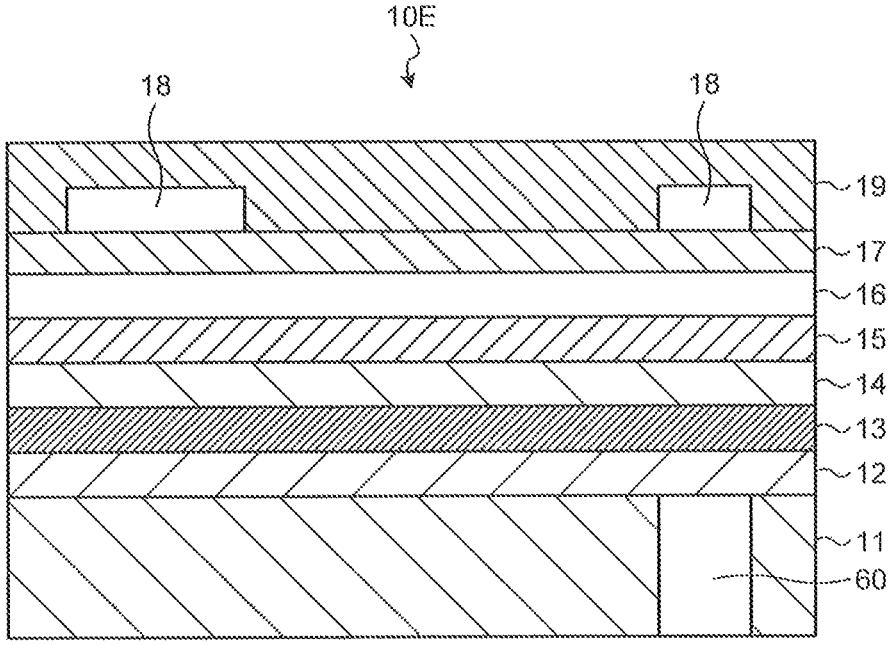
FIG. 20 is a cross-sectional view of a recording medium according to a fifth embodiment.

FIG. 20 is a cross-sectional view of the recording medium of the fifth embodiment.

A recording medium 10E of the fifth embodiment is different from the above embodiments in that a transparent base material 60 obtained by forming a part of the base material 11 of a transparent member is provided.

According to this configuration, it is possible to easily determine the authenticity by determining whether the image formed on the recording medium 10E from the base material 11 side is the same as a regular recording medium.

Figure 21:
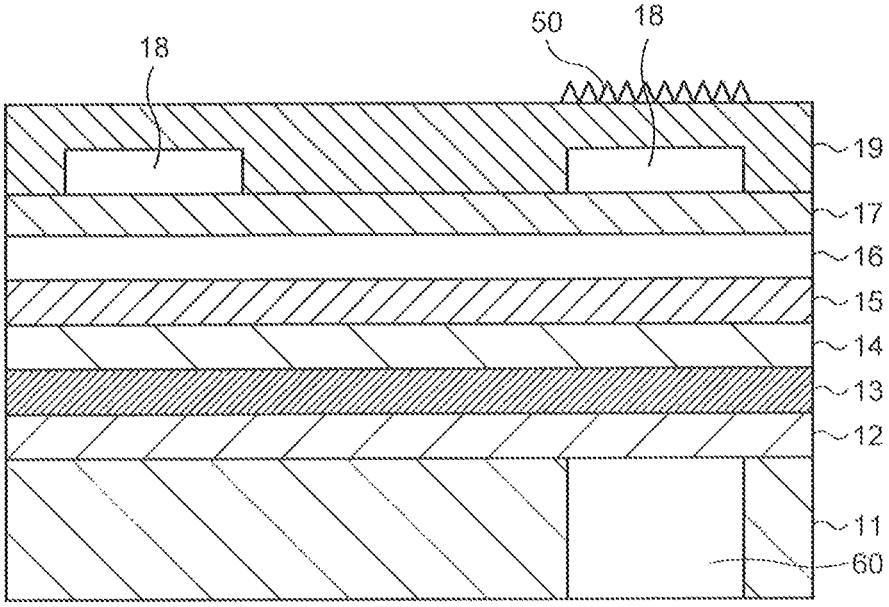
FIG. 21 is an explanatory view of a recording medium in the fifth embodiment.

FIG. 21 is an explanatory view of a recording medium of the fifth embodiment.

A recording medium 10F of the modification of the fifth embodiment is different from the fifth embodiment illustrated in FIG. 20 in that the lenticular lens 50 is provided on the protective/functional layer 19 or integrally with the protective/functional layer 19.

With this configuration, it is possible to switch the image displayed depending on the viewing angle by performing image formation on the recording medium 10F while changing the irradiation direction of the near-infrared laser light LNIR at the time of image formation.

In the example of FIG. 21, since the photothermal conversion layer 18 is provided in the recordable area of the lenticular lens 50, the dot pattern of the full-color image formed through the lenticular lens 50 is unique with its formed image. Thus, it is possible to easily determine the authenticity and detect and eliminate counterfeit products or forged products.

Sixth Embodiment

In each of the above embodiments, the recording medium is handled as a single unit. A sixth embodiment is an embodiment of a card-like recording medium including the recording medium and a carrier (member having a card shape such as paper, plastic, metal, or ceramics) that carries the recording medium.

In the following, for better understanding, the recording medium 10 is carried on a carrier as an example.

Figure 22:
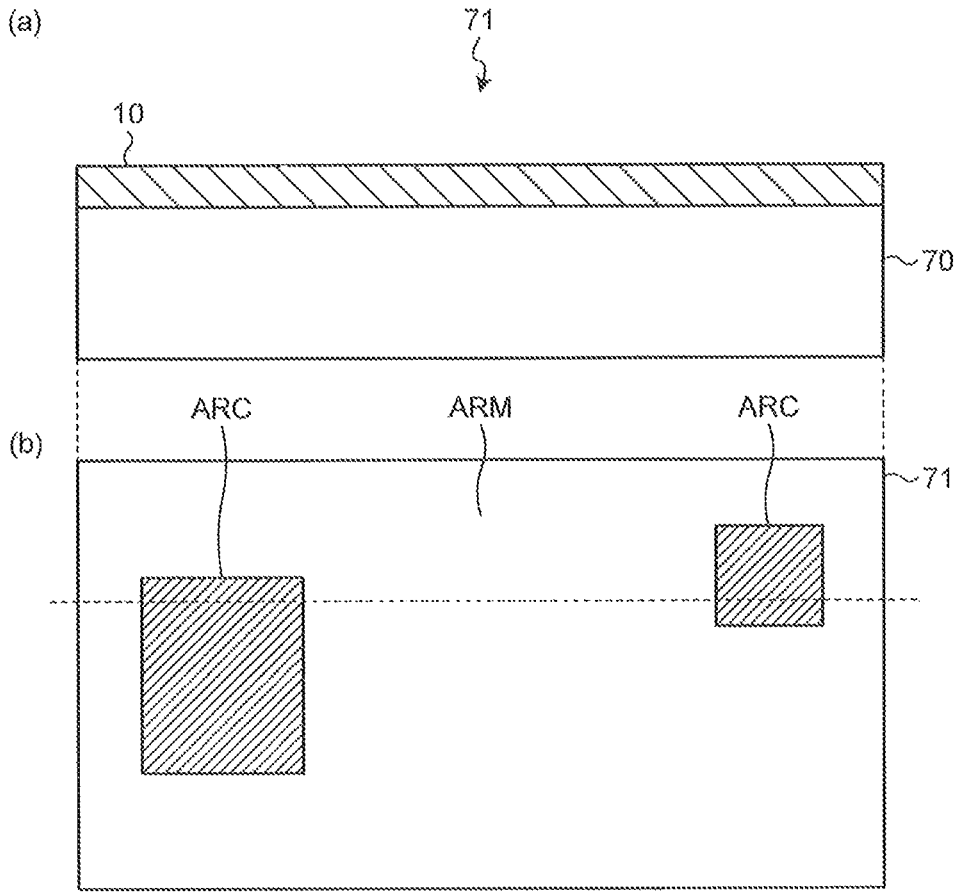
FIG. 22 is an explanatory view of a card-like recording medium according to a sixth embodiment.

FIG. 22 is an explanatory view of a card-like recording medium of the sixth embodiment.

FIG. 22(*a*) is a cross-sectional view, and FIG. 22(*b*) is a plan view.

FIG. 22(*a*) is a cross-sectional view taken along the broken line in FIG. 22(*b*).

As illustrated in FIG. 22(*a*), the recording medium 10 is carried on a carrier 70 to form a card-like recording medium 71.

As described above, according to the sixth embodiment, since the recording medium 10 is carried by the carrier 70, the fastness is improved, and the recording medium 10 can be a highly reliable recording medium over a long period of time.

First Modification of Sixth Embodiment

Figure 23:
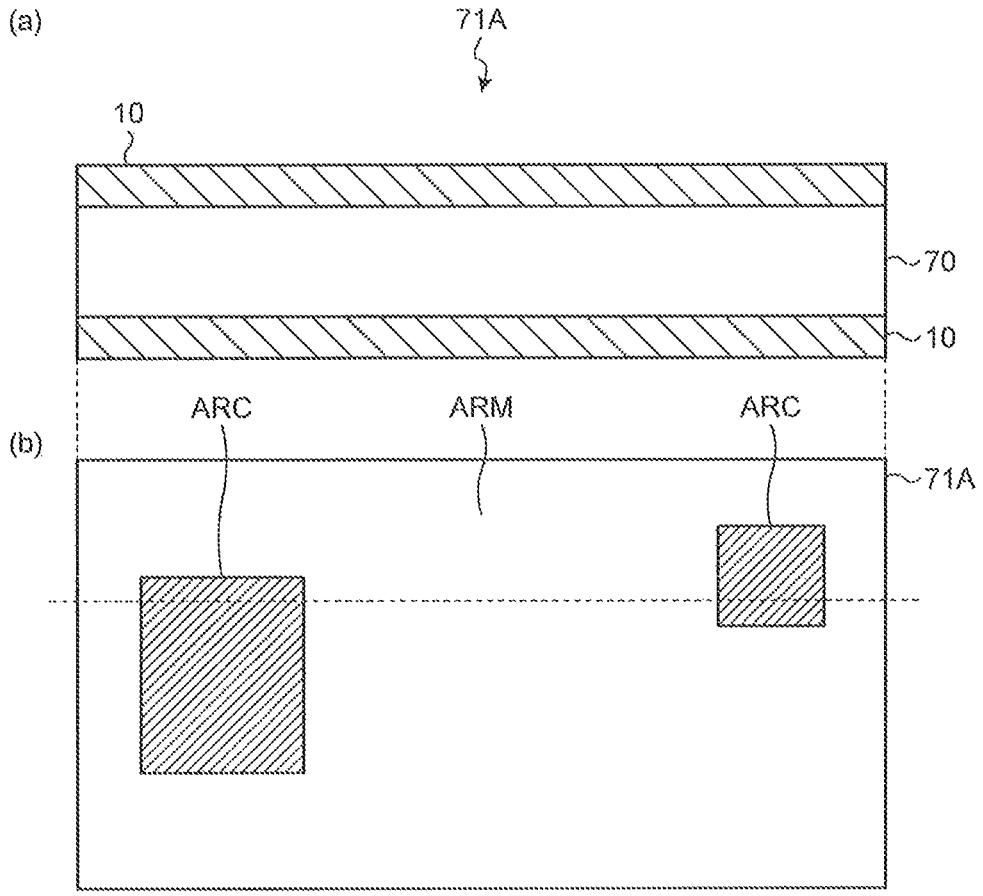
FIG. 23 is an explanatory view of a card-like recording medium of a first modification in the sixth embodiment.

FIG. 23 is an explanatory view of a card-like recording medium of a first modification of the sixth embodiment.

FIG. 23(*a*) is a cross-sectional view, and FIG. 23(*b*) is a plan view.

FIG. 23(*a*) is a cross-sectional view taken along the broken line in FIG. 23(*b*).

A card-like recording medium 71A of the first modification of the sixth embodiment is different from the sixth embodiment in that two recording media 10 are respectively carried on both surfaces of the carrier 70.

By adopting such a configuration, in addition to the effects of the sixth embodiment, recording can be performed on both surfaces of the card-like recording medium 71A. Furthermore, the strength of the card-like recording medium 71A can be improved and deformation can be prevented.

Second Modification of Sixth Embodiment

Figure 24:
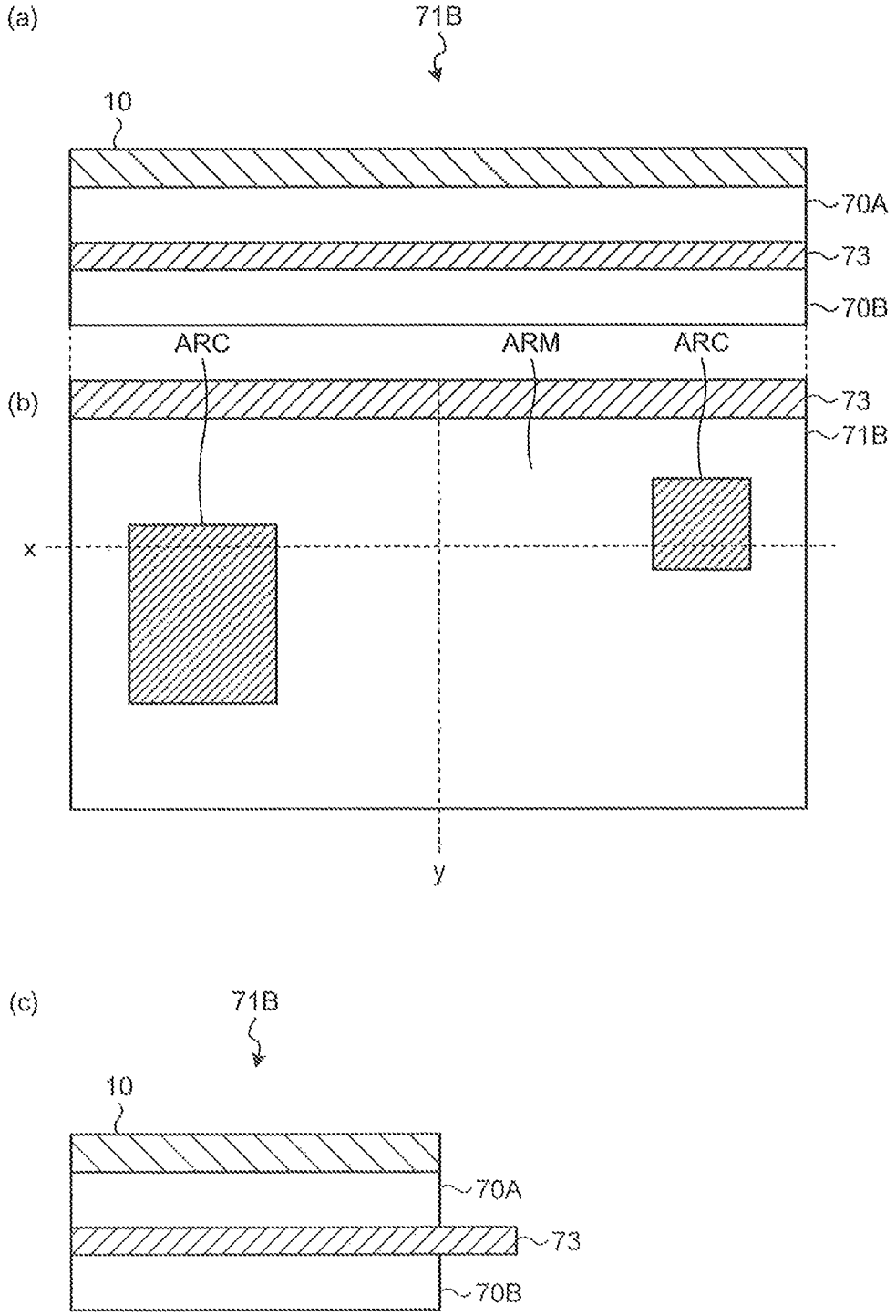
FIG. 24 is an explanatory view of a card-like recording medium of a second modification in the sixth embodiment.

FIG. 24 is an explanatory view of a card-like recording medium of a second modification of the sixth embodiment.

FIG. 24(*a*) is a first cross-sectional view, FIG. 24(*b*) is a plan view, and FIG. 24(*c*) is a second cross-sectional view.

FIG. 24(*a*) is a cross-sectional view taken along the broken line x in FIG. 24(*b*), and FIG. 24(*c*) is a cross-sectional view taken along the broken line y in FIG. 22(*b*).

A card-like recording medium 71B of the second modified example of the sixth embodiment is different from the sixth embodiment in that the recording medium 10 is carried by two carriers 70A and 70B sandwiching a hinge 73.

In this case, in addition to the effects of the sixth embodiment, it is possible to make it difficult to remove the card-like recording medium 71B from a booklet by binding one or more card-like recording media 71B into the booklet at the hinge 73 portion. This can prevent falsification and improve security.

Third Modification of Sixth Embodiment

Figure 25:
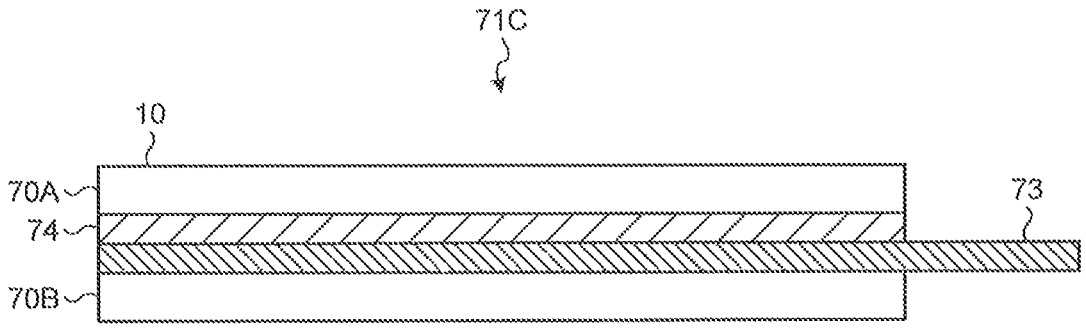
FIG. 25 is an explanatory view of a card-like recording medium of a third modification in the sixth embodiment.

FIG. 25 is an explanatory view of a card-like recording medium of a third modification of the sixth embodiment.

A card-like recording medium 71C of the third modified example of the sixth embodiment is different from the sixth embodiment in that the recording medium 10 is carried by the two carriers 70A and 70B sandwiching the hinge 73 and a card core 74 configured as an IC card or the like.

In this case, in addition to the effects of the sixth embodiment, by incorporating various functions into the card core 74, a high-performance card-like recording medium can be obtained, and the recording data can be digitized and encrypted. As a result, the security can be further improved.

Fourth Modification of Sixth Embodiment

Figure 26:
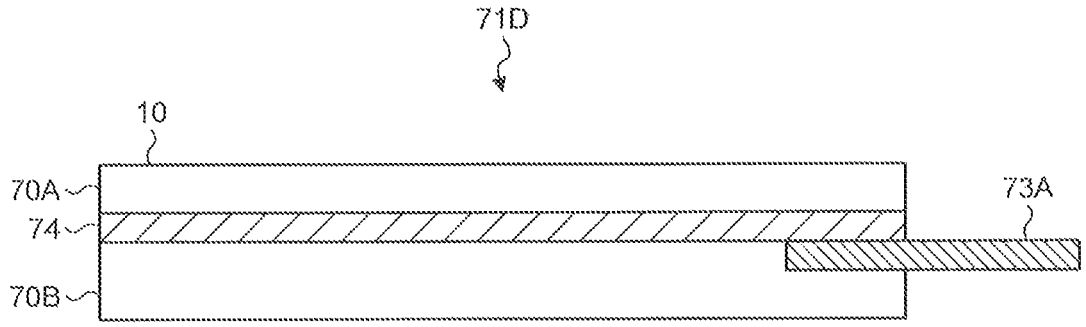
FIG. 26 is an explanatory view of a card-like recording medium of a fourth modification in the sixth embodiment.

FIG. 26 is an explanatory view of a card-like recording medium of a fourth modification of the sixth embodiment.

A card-like recording medium 71D of the fourth modification example of the sixth embodiment is different from the third modification example of the sixth embodiment of FIG. 25 in that a short hinge 73A is provided instead of the hinge 73.

According to the fourth modification of the sixth embodiment, in addition to the effects of the third modification of the sixth embodiment, it is possible to decrease the thickness of the card-like recording medium and increase the number of bind-in sheets.

Modification of Embodiments

The above embodiments have described the example of two to four color development layers, but they can be similarly applied to five or more color development layers.

For example, the above embodiments have described CMYK four-color recording. However, they can also be applied to CMYRGBK seven-color recording having seven color development layers of cyan (C), magenta (M), yellow (Y), red (R), green (G), blue (B), and black (K).

The above embodiments have described the example of using near-infrared laser light as laser light. However, it is also possible to use near-ultraviolet laser light and far-ultraviolet laser light as laser light depending on the absorption wavelength of the photothermal conversion layer.

The above embodiments have described the example that the control unit 42, the output control unit 43, and the irradiation-position control unit 44 are independent elements. However, they may be configured as a computer including an MPU, ROM, and RAM, and their functions may be executed by programs via various interfaces.

In this case, the program executed by the computer may be recorded on a computer-readable recording medium in an installable or executable file format such as a semiconductor recording device such as a CD-ROM, a DVD (Digital Versatile Disk), or a USB memory.

In addition, a program executed by a computer may be stored and provided in a computer connected to a network such as the Internet by being downloaded via the network. The program executed by the control unit 42 may be provided or distributed via a network such as the Internet.

A program executed by a computer may be incorporated in advance in a ROM.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A recording medium comprising:

a base material;

a first color development layer that is located on the base material and absorbs light of a given wavelength to develop color;

a second color development layer that is located closer to an incident side of the given-wavelength light than the first color development layer, transmits visible light and the given-wavelength light, and develops a color by heat;

a protective layer that is provided on the second color development layer; and a photothermal conversion layer that is located closer to an incident side of the light than the second color development layer intended to develop a color, transmits the visible light, and absorbs the given-wavelength light to photo-thermally convert the given-wavelength light into the heat, wherein the second color development layer comprises a plurality of second color development layers, and the photothermal conversion layer comprises a plurality of photothermal conversion layers corresponding to the plurality of second color development layers intended to develop respective colors, the plurality of photothermal conversion layers being arranged within the protective layer to be horizontally apart from each other.

2. The recording medium according to claim 1, wherein the second color development layers are apart from each other through an intermediate layer that adjusts an amount of heat transfer, and the second color development layers have mutually different color-development threshold temperatures.

3. The recording medium according to claim 2, wherein the second color development layers are arranged such that the higher a color-development threshold temperature the second color development layer has, the larger the amount of heat transfer from the photothermal conversion layer the second color development layer receives.

4. The recording medium according to claim 2, wherein the second color development layers are arranged such that the higher a color-development threshold temperature the second color development layer has, the closer to the photothermal conversion layer the second color development layer is located.

5. The recording medium according to claim 1, wherein the first color development layer includes a monochrome recording layer, and the second color development layer includes a color recording layer.

6. The recording medium according to claim 2, wherein the first color development layer includes a monochrome recording layer, the second color development layer includes a color recording layer, and the number of the second color development layers is at least three, and the second color development layers function as a full-color recording layer as a whole.

7. The recording medium according to claim 5, wherein the recording medium comprises a recording surface including a monochrome image area and a color image area, and the photothermal conversion layer is located corresponding to the color image area.

8. The recording medium according to claim 1, wherein the second color development layer serves as a thermosensitive color development layer that transmits the light and the visible light.

9. A recording device that performs recording on a recording medium, the recording device comprising a recording medium, said recording medium comprising:

a base material;

a first color development layer that is located on the base material and absorbs light of a given wavelength to develop color;

a second color development layer that is located closer to an incident side of the given-wavelength light than the first color development layer, transmits visible light and the given-wavelength light, and develops a color by heat;

a protective layer that is provided on the second color development layer; and a photothermal conversion layer that is located closer to an incident side of the light than the second color development layer intended to develop a color, transmits the visible light, and absorbs the given-wavelength light to photo-thermally convert the given-wavelength light into the heat, wherein the second color development layer comprises a plurality of second color development layers, and the photothermal conversion layer comprises a plurality of photothermal conversion layers corresponding to the plurality of second color development layers intended to develop respective colors, the plurality of photothermal conversion layers being arranged within the protective layer to be horizontally apart from each other; and wherein the recording medium further comprises:

a light source that emits the light;

an optical system that guides the light to a recording surface of the recording medium;

an irradiation-position control unit that controls an irradiation position of the light; and an output control unit that controls, for color development of the second color development layer, an amount of heat generation from the photothermal conversion layer by controlling output of the light to be incident on the photothermal conversion layer.

* * * * *